US007722295B2

(12) United States Patent
Cook

(10) Patent No.: US 7,722,295 B2
(45) **Date of Patent: *May 25, 2010**

(54) EXPANSION SHELL ASSEMBLY

(75) Inventor: James D. Cook, St. Clairsville, OH (US)

(73) Assignee: Met-Tech Industries, Inc., Cambridge, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/822,455

(22) Filed: Apr. 12, 2004

(65) Prior Publication Data

US 2004/0191004 A1 Sep. 30, 2004

Related U.S. Application Data

(63) Continuation of application No. 10/044,467, filed on Jan. 11, 2002, now Pat. No. 6,742,966.

(60) Provisional application No. 60/261,495, filed on Jan. 12, 2001.

(51) Int. Cl.
*E21D 21/00* (2006.01)

(52) U.S. Cl. ..... 405/259.4; 411/32

(58) Field of Classification Search ..... 405/259.1, 405/259.3–259.6; 411/24, 26, 82, 82.3, 258, 411/930, 32, 1, 5, 8, 9

See application file for complete search history.

(56) References Cited

U.S. PATENT DOCUMENTS

| | | | | |
|---|---|---|---|---|
| 508,254 | A * | 11/1893 | Steward | 411/26 |
| 660,559 | A | 10/1900 | Church | |
| 1,072,246 | A | 9/1913 | Masor | |
| 1,120,368 | A | 12/1914 | Booraem et al. | |
| 2,647,431 | A | 8/1953 | Lewis | |
| 2,667,099 | A | 1/1954 | Lewis | |
| 2,783,673 | A | 3/1957 | Lewis et al. | |
| 3,188,815 | A | 6/1965 | Schuermann et al. | |
| 3,227,031 | A | 1/1966 | Williams | |
| 3,315,557 | A | 4/1967 | Dickow | |
| 3,941,028 | A | 3/1976 | Lobello et al. | |
| 4,051,683 | A | 10/1977 | Koval | |
| 4,160,614 | A | 7/1979 | Koval | |
| 4,162,133 | A | 7/1979 | Clark et al. | |
| 4,173,918 | A | 11/1979 | Piersall | |
| 4,192,631 | A | 3/1980 | Vass | |
| 4,193,715 | A | 3/1980 | Vass | |
| 4,194,858 | A | 3/1980 | Evans | |

(Continued)

OTHER PUBLICATIONS

Frazer & Jones, Mine Roof Support Anchors.

(Continued)

*Primary Examiner*—Sunil Singh
(74) *Attorney, Agent, or Firm*—Fay Sharpe LLP

(57) ABSTRACT

An expansion shell assembly for mine roof bolts includes an expansion member threaded onto an associated mine roof bolt. A support device is annularly disposed around the associated roof bolt. An expansion shell is annularly disposed around the associated roof bolt between the expansion member and the support device. The expansion shell has a base ring for engaging the support device and fingers for engaging a peripheral edge of the expansion member. The engagement between the base ring and the support device permits axial traverse movement of the support device relative to the expansion shell for tensioning the roof bolt.

27 Claims, 10 Drawing Sheets

U.S. PATENT DOCUMENTS

| | | | | |
|---|---|---|---|---|
| 4,299,515 | A | | 11/1981 | Yates et al. |
| 4,413,930 | A | | 11/1983 | Calandra, Jr. |
| 4,419,805 | A | | 12/1983 | Calandra, Jr. |
| 4,483,645 | A | | 11/1984 | White et al. |
| RE31,776 | E | | 12/1984 | Clark et al. |
| 4,497,403 | A | | 2/1985 | Rausch |
| 4,512,292 | A | | 4/1985 | Hundertmark |
| 4,516,883 | A | | 5/1985 | Zeitler |
| 4,516,885 | A | | 5/1985 | Calandra, Jr. |
| 4,516,886 | A | | 5/1985 | Wright |
| 4,518,292 | A | | 5/1985 | Calandra, Jr. |
| 4,534,679 | A | | 8/1985 | White et al. |
| 4,534,680 | A | | 8/1985 | White et al. |
| 4,556,344 | A | | 12/1985 | White |
| 4,611,954 | A | | 9/1986 | Cassidy |
| 4,655,645 | A | | 4/1987 | Hipkins, Sr. et al. |
| 4,664,561 | A | | 5/1987 | Frease |
| 4,678,374 | A | | 7/1987 | Calandra, Jr. |
| 4,679,966 | A | | 7/1987 | Yacisin |
| 4,704,053 | A | | 11/1987 | Hipkins, Sr. et al. |
| 4,764,055 | A | | 8/1988 | Clark et al. |
| 4,861,197 | A | | 8/1989 | Calandra, Jr. |
| 4,861,198 | A | | 8/1989 | Stankus |
| 4,904,123 | A | | 2/1990 | Calandra, Jr. et al. |
| 4,913,593 | A | | 4/1990 | Clark et al. |
| 4,969,778 | A | | 11/1990 | Calandra, Jr. et al. |
| 5,009,549 | A | | 4/1991 | Stankus |
| 5,011,337 | A | * | 4/1991 | Clark et al. ..... 405/259.6 |
| 5,033,910 | A | | 7/1991 | Wright |
| 5,042,961 | A | | 8/1991 | Scott et al. |
| 5,052,861 | A | | 10/1991 | Hipkins, Sr. |
| 5,064,311 | A | | 11/1991 | Giroux et al. |
| 5,064,312 | A | | 11/1991 | Calandra, Jr. et al. |
| 5,073,065 | A | | 12/1991 | Kleineke |
| 5,076,734 | A | | 12/1991 | Hipkins, Sr. |
| 5,078,547 | A | | 1/1992 | Calandra, Jr. et al. |
| 5,082,399 | A | | 1/1992 | Frease et al. |
| 5,184,923 | A | | 2/1993 | Calandra, Jr. et al. |
| 5,219,248 | A | | 6/1993 | Wright |
| 5,232,311 | A | | 8/1993 | Stankus |
| 5,244,314 | A | | 9/1993 | Calandra, Jr. et al. |
| 5,275,512 | A | | 1/1994 | Wright |
| 5,316,414 | A | | 5/1994 | Wright |
| 5,344,257 | A | | 9/1994 | Wright et al. |
| 5,352,066 | A | | 10/1994 | Schaeffer et al. |
| 5,501,551 | A | | 3/1996 | Wright |
| 5,599,140 | A | | 2/1997 | Wright |
| 5,816,759 | A | * | 10/1998 | Ernst et al. ..... 411/24 |
| RE36,019 | E | | 12/1998 | Stankus |
| 6,742,966 | B2 | * | 6/2004 | Cook ..... 405/259.6 |

OTHER PUBLICATIONS

George W. Allen, *Roof Control and Mine Bolts*, Coal Age, 86-91 (Mar. 1963).

* cited by examiner

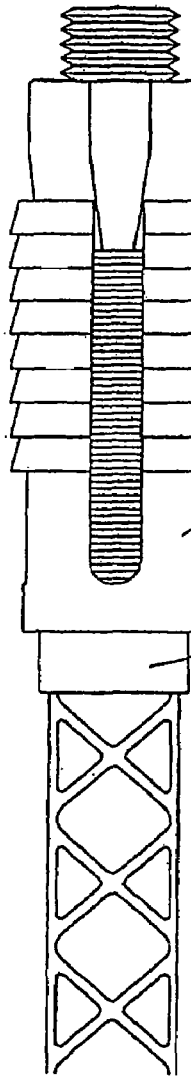
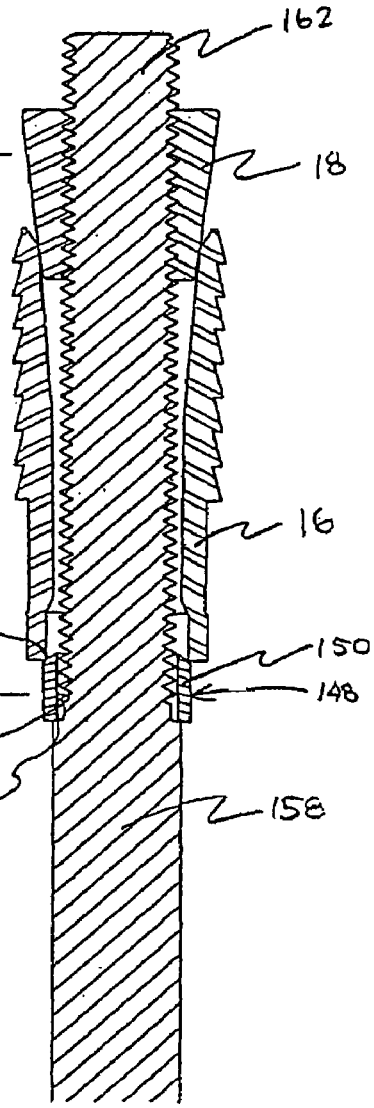
CAMMING PLUG
SHELL
SUPPORT DEVICE
FIG. 7a
FIG. 7b

EXPANSION SHELL ASSEMBLY

This application is a continuation of prior application U.S. Ser. No. 10/044,467 filed Jan. 11, 2002, now U.S. Pat. No. 6,742,966, which claims the benefit of U.S. Provisional Patent Application Ser. No. 60/261,495, filed on Jan. 12, 2001 and hereby expressly incorporates both by reference.

BACKGROUND OF THE INVENTION

1. Field of the Invention

The present invention relates to an improved expansion shell assembly for mine roof bolts and, more specifically, to an improved expansion shell assembly, and elements thereof, having novel features particularly adapted for the improved support and release of an expansion shell during installation of a mine roof bolt.

2. Description of the Art

It is well known in the art of mine roof control to tension bolts anchored in bore holes drilled into the mine roof in order to reinforce the unsupported rock formation above the roof. Conventionally, a hole is drilled into the rock formation. The end of the bolt in the rock formation is anchored either by engagement of an expansion shell assembly on the end of the bolt with the rock formation, by bonding the bolt with resin to the rock formation surrounding the bore hole, or by use of both an expansion shell assembly and resin together to retain the bolt within the hole.

Mechanical expansion shell assemblies for roof bolts have been used for many years in the anchorage of bolts in rock formations. An expansion shell assembly includes an expansion member such as a camming plug or tapered plug threaded onto one end of a mine roof bolt and positioned within the upper end portion of an expansion shell. The expansion shell is held in place by a support device such as a PALNUT positioned adjacent to the lower end portion of the expansion shell.

During rotation of the bolt, the frictional engagement of the expansion shell with the rock formation surrounding the bore hole prevents rotation thereof. Also, by virtue of the frictional engagement between the upper end of the support device with the lower end of the expansion shell, the support device will not rotate but, upon rotation of the bolt, the support device, the expansion shell and the tapered plug move downwardly along the bolt until the support device reaches the unthreaded portion of the bolt.

Continued rotation of the bolt causes the tapered plug to advance downwardly on the bolt and urges the expansion shell fingers to expand or deflect radially outwardly to grip the rock formation surrounding the bore hole. With the expansion shell engaged with the rock formation, continued rotation of the bolt causes the bolt to advance upwardly, thereby pushing or stripping the support device off the threaded portion of the bolt. Concurrently, rotation of the bolt urges a bearing plate positioned on the bolt at an end opposite the expansion shell assembly against the rock formation, putting the rock formation in compression and the bolt in tension.

Current practice provides roof bolt systems using resin in conjunction with a mechanical anchor. These types of systems require a resin cartridge to be inserted in the bore hole. The bolt is then inserted in the bore hole and thrust upwardly to rupture the resin cartridge. The bolt is rotated, mixing the resin and setting the mechanical anchor. Two of the advantages of resin-using systems are a tensioned resin anchor and quick installation provided by the mechanical anchor.

Examples of arrangements utilizing both an expansion shell assembly and resin to anchor a mine roof bolt in a rock formation are disclosed in U.S. Pat. Nos. 4,419,805; 4,413,930; 4,516,885 and 4,518,292, all expressly incorporated herein by reference. Other examples of both an expansion shell assembly and resin to anchor a mine roof bolt are disclosed in U.S. Pat. Nos. 3,188,815; 4,162,133; 4,655,645 and 4,664,561, all expressly incorporated herein by reference.

In general, any support device of an expansion shell assembly of the prior art performs three functions during installation of the roof bolt. First, the support device maintains the expansion shell in engagement with the camming plug during insertion in the bore hole. Second, with the support device positioned adjacent the lower end of the bolt threaded portion, the support device maintains the expansion shell in a fixed axial position on the bolt thereby allowing the tapered plug to advance downwardly on the bolt and urge the expansion fingers radially outwardly to grip the rock formation. Finally, with the expansion shell engaged with the rock formation, the support device strips off the threaded portion of the bolt thereby allowing the bolt to advance upwardly and be properly tensioned.

Some early combination resin/mechanical anchor systems used a PALNUT as the support device to maintain the expansion shell in engagement with the camming plug during insertion in the bore hole. However, because of the tight clearance between the expansion shell fingers and the bore hole wall, along with the high resistance to the flow of resin caused by the anchor, the PALNUT was prone to prematurely strip off the threaded portion of the bolt. When a premature failure occurred, the expansion shell was pushed downwardly and disengaged from the camming plug. The result was an expansion shell assembly unable to engage the rock formation, a condition known in the industry as a "spinner".

Manufacturers now use a hex or round jamnut of a various thickness as the support device. Although the heavier jamnut solved the premature stripping problem, it created a different problem. It has been determined that the heavier jamnut may not strip off the threaded portion. As a result, rotation of the bolt causes the expansion shell to be compressed between the camming plug and the support device. The expansion shell may become severely distorted, ripped, torn or twisted. In addition, when the jamnut fails to release, significant tension occurs in the bolt threaded portion between the camming plug and the jamnut. This tension translates into torque being measured by the roof bolt installation machine. It is common practice to install a roof bolt to a predetermined desired torque. Since significant torque is being created at the expansion shell assembly, significantly reduced torque/tension is being applied to the roof bolt. Thus, the actual tension in the bolt may be significantly less than the desired tension in the bolt.

While expansion shell assemblies for anchoring mine roof bolts in bore holes are well known, there is need to improve the operability of the support device, particularly when used with resin. The support device must have the capability to support the expansion shell during insertion in the bore hole and engagement with the bore hole wall. At the same time, the support device must have the capability to release its axially supporting engagement with the expansion shell once the expansion shell is set in the rock formation to allow for proper tensioning of the bolt while reducing or eliminating torsion and/or compression between the camming plug and the support device.

SUMMARY OF THE INVENTION

In accordance with one aspect of the present invention, an expansion shell assembly for mine roof bolts comprises an expansion member threaded onto an associated mine roof bolt. A support device is annularly disposed around the associated roof bolt. An expansion shell is annularly disposed around the associated roof bolt between the expansion member and the support device. The expansion shell has a base ring for engaging the support device and fingers for engaging a peripheral edge of the tapered plug. The engagement between the base ring and the support device permits axial traverse movement of the support device relative to the expansion shell for tensioning the roof bolt.

In accordance with another aspect of the present invention, a bolt and anchor assembly for securing a mine roof bolt comprises an elongated bolt and an expansion shell having an aperture for receiving the elongated bolt. An expansion member is disposed on one end of the elongated bolt for expanding the expansion shell. A shell support has a shell engaging portion radially disposed between and in contact with the elongated bolt and the expansion shell for maintaining the axial position of the expansion shell relative to the elongated bolt while the expansion member forces the shell to engage a rock formation and for moving axially relative to the expansion shell while the elongated bolt is tensioned after engagement to the rock formation.

In accordance with another aspect of the present invention, an expansion shell assembly for mine roof bolts comprises an expansion member threaded onto an associated bolt. A support device is annularly disposed around the associated bolt. A shell is annularly disposed on the bolt between the expansion member and the support device. The expansion shell has a base ring with a tapered surface for mating engagement a corresponding tapered surface of the support device and fingers for engaging the expansion member. The mating engagement allows increasing friction forces to hold the support device in a non-rotating position at a predetermined bolt torque.

In accordance with yet another aspect of the present invention, a method for anchoring an elongated threaded member to a rock formation is provided. An elongated member having a threaded end portion that is to be anchored to a rock formation is provided. An expansion shell assembly is provided on the threaded end portion of the elongated member. The expansion shell assembly comprises an expansion shell, a plug for expanding the expansion shell, and a support member for supporting the expansion shell. A blind drilled hole is formed in the rock formation for the elongated member and the expansion shell assembly. The elongated member with the expansion shell assembly carried thereon is advanced into the blind drilled hole. The elongated member is rotated to effect a gripping of the rock formation by the expansion shell assembly within the blind drilled hole. The support member generally maintains engagement between the plug and the expansion shell. The elongated member is further rotated to tension the elongated member. The support member axially traverses within the expansion shell permitting the tensioning.

In accordance with still another aspect of the present invention, a method of installing a mine roof bolt assembly is provided. A mine roof bolt assembly is inserted into a hole of a rock formation. The mine roof bolt assembly comprises a mine roof bolt, an expansion member threadingly engaged to the mine roof bolt, an expansion shell, and a support. The expansion shell has fingers engaged with expansion member and a base portion engaged with the support. The hole is appropriately sized to frictionally prevent rotation of the expansion shell. The engagement of the fingers restricts rotation of the expansion member. The mine roof bolt assembly is anchored to the rock formation within the hole by rotating the mine roof bolt. Said rotation causes the support to force the expansion shell against the expansion member thereby forcing the fingers of the expansion shell to move radially outwardly and grip the rock formation. The mine roof bolt is tensioned by continuing to rotate the mine roof bolt. Said continued rotation causes the support to forcibly move within the base portion of the expansion shell.

BRIEF DESCRIPTION OF THE DRAWINGS

The invention may take form in various components and arrangements of components, and in various steps and arrangements of steps. The drawings are only for purposes of illustrating the presently preferred embodiments and are not to be construed as limiting the invention.

FIG. 7*a* is an elevational view of an expansion shell assembly having an unthreaded support device on a mine roof bolt in a precisely controlled diameter arrangement in accordance with another preferred embodiment of the present invention;

FIG. 7*b* is a cross sectional view of the expansion shell assembly of FIG. 7*a;*

DETAILED DESCRIPTION OF THE INVENTION

In accordance with the present invention, there is provided an expansion shell assembly for anchoring a bolt in a bore hole that includes an expansion shell, an expansion member such as a tapered camming plug, and a novel support device. The expansion shell has a circular base portion or base ring and a plurality of longitudinally extending fingers generally equally spaced from one another. Each finger is formed integral at one end portion with the circular base portion and extends upwardly therefrom to form a free end portion for outward expansion of the finger. The fingers each have an inner surface for engaging the side wall of the camming plug and a ribbed outer surface for frictionally engaging the bore hole. The camming plug has a threaded axial bore for engaging the end of the bolt, an upper end portion, a lower end portion, and a surrounding side wall tapering inwardly from said upper end portion to said lower end portion. The inner surface of the fingers abuts the plug side wall. The novel support device in general consists of a ring-like structure with an axial bore that may or may not be threaded, a lower end portion, an upper end portion whose outer diameter is less than the lower end portion, and an outer surface of a predetermined transition configuration.

Unlike prior art where the support device such as a PALNUT or a jamnut had to be forced axially down the bolt by the expansion shell during tensioning of the bolt, this support device cooperates with the expansion shell base portion in one of two general ways. In one way, as illustrated in at least FIGS. 1*a* through 9*b*, the upper end portion of the support device cooperates with the expansion shell base portion to cause the expansion shell base portion to diametrically expand and/or fracture and, at a predetermined axial force, allow the support device to traverse axially therethrough during tensioning of the bolt. In another way, as illustrated in FIGS. 10*a* and 10*b*, the upper end portion of the support device cooperates with the expansion shell base portion to cause the support device to be held in a fixed, non-rotating position thereby allowing the bolt to advance upwardly at a predetermined torque.

There are several ways to practice the invention as discussed in detail below. However, it should be understood by one skilled in the art that the invention may be practiced otherwise than as specifically illustrated and described below. It should also be noted that the invention may be practiced with the following U.S. Pat. Nos. 4,413,930; 4,419,805; 4,516,885; 4,518,292; 4,664,561; 4,678,374; 4,679,966; 4,764,055; 4,904,123; 4,913,593; 4,969,778; 5,011,337; 5,244,314, all expressly incorporated herein by reference.

Figure 1A:
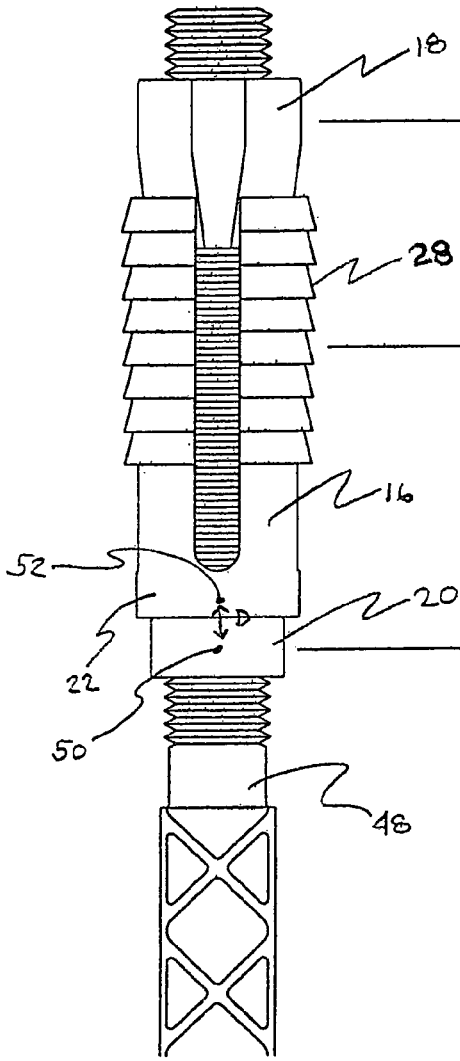
FIG. 1*a* is an elevational view of an expansion shell assembly having a support device on a mine roof bolt in a precisely controlled diameter arrangement in accordance with a first preferred embodiment of the present invention.
Figure 1B:
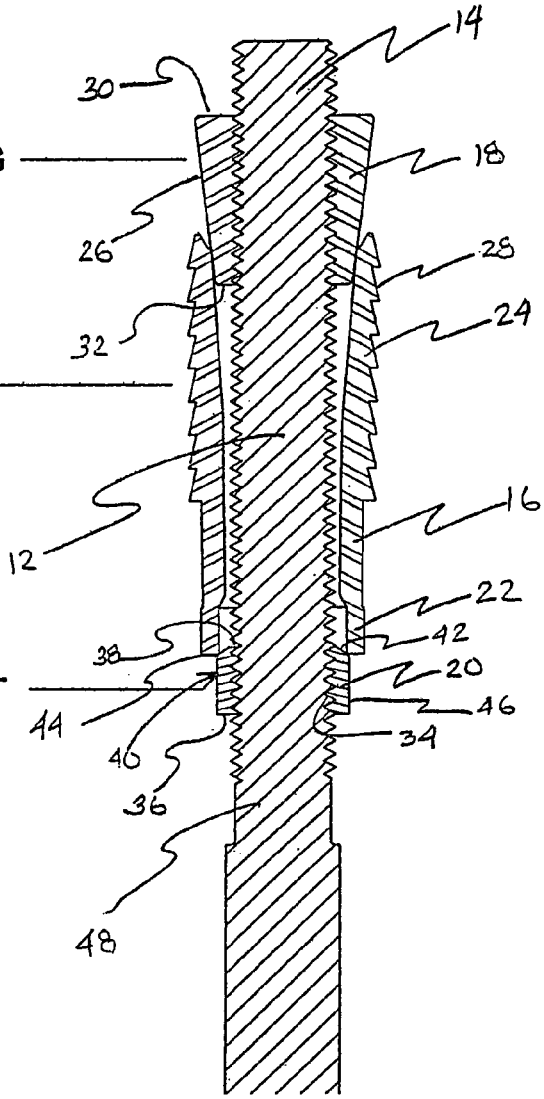
FIG. 1*b* is a cross sectional view of the expansion shell assembly of FIG. 1*a;*

Referring now to the drawings wherein like reference characters represent like elements, with reference to FIGS. 1*a* and 1*b*, an expansion shell assembly is shown in a precisely controlled diameter arrangement. The expansion shell assembly connects to a mine roof bolt 12 on a threaded end 14 thereof and comprises an expansion shell 16, a tapered camming plug 18, and a support device 20 according to a first preferred embodiment of the present invention.

The expansion shell 16 has a circular base portion 22 and a plurality of longitudinally extending fingers 24 generally spaced apart from one another. The inner surface or inner diameter of the circular base portion 22 is a precisely controlled diameter relative to an outside diameter of the support device 20 creating a controlled interference fit such as a 0.030 inch diametral fit. That is, the inner diameter of the base portion 22 is 0.030 inches smaller than the outside diameter of the support device 20. This is in contrast to conventional prior art expansion shells which are often formed by casting resulting in significantly higher tolerances. The controlled relationship between the controlled diameter and the outer diameter of the support device 20 facilitates fracture and/or expansion of the base portion 22 during installation as will be discussed in more detail below. Each of the fingers 24 is formed integral at one end with the circular base portion 22 and extends upwardly therefrom to form a free end portion for outward expansion of the finger 24. The fingers 24 each have an inner surface for engaging one of a plurality of flat side walls 26 of the camming plug 18 and an outer ribbed surface 28 for frictionally engaging a bore hole (not shown) formed within a rock formation.

The tapered camming plug 18 has a threaded axial bore for engaging the threaded end portion 14 of the bolt 12, an upper end 30, a lower end 32, and the surrounding flat side walls 26 tapering inwardly from the upper end 30 to the lower end 32. Each of the plurality of side walls 26 abuts the inner surface of one of the fingers 24 of the expansion shell 16.

The support device 20 has a threaded axial bore 34 for threaded engagement with the bolt 12, a lower end 36, an upper end 38 whose outer diameter is less than the lower end 36, and a surrounding side wall 40 that transitions outwardly from the upper end 38 to the lower end 36. The outer transition surface 40 has an outwardly tapered portion 42 beginning at the upper end, a transition radius portion 44 (such as about 0.030 inches), and a straight portion 46 that is parallel to the axial bore ending at the lower end 36. The straight portion 46 defines the outside diameter of the support device 20 which determines the size of the controlled diameter of the base portion 22. In the precisely controlled diameter arrangement illustrated, the tapered portion 42 is approximately sixty degrees relative to a vertical axis of the bolt 12. Of course, other taper angles can be used to achieve the same result and all such configurations are to be considered within the scope of the present invention.

For installation in the bore hole, the support device 20, the expansion shell 16, and the camming plug 18 are positioned on the threaded end portion 14 of the mine roof bolt 12 as illustrated. More specifically, the support device 20 is threaded onto the bolt 12 to a position located slightly above an unthreaded portion 48 as illustrated. Alternatively, the support device 20 can be threaded onto the bolt 12 until it reaches or is adjacent the unthreaded portion 48. The expansion shell 16 and the camming plug 18 are then positioned on the bolt 12 such that the circular base portion 22 overlaps the tapered surface of the support device 20 as shown. As can readily be seen, the expansion shell 16 is sandwiched between the camming plug 18 and the support device 20. The expansion shell assembly 10 and the bolt 12 are then inserted in the bore hole. In this instance, the expansion shell 16 and roof bolt 12 are utilized without resin bonding. However, it will be appreciated that the expansion shell assembly of the present invention can also be utilized with resin.

For resin bonding, a resin cartridge (not shown) is positioned within the bore hole above the expansion shell assembly. The expansion shell assembly, attached to the bolt 12 as described above, is thrust upwardly in the bore hole to rupture the resin cartridge. During insertion in the bore hole, the expansion shell fingers 24 are held in engagement with the camming plug 18 by the support device 20. In particular, the outwardly tapered portion of the support device 20 cooperates with the circular base portion 22 of the expansion shell 16 thereby maintaining the shell fingers 24 in engagement with the camming plug 18.

As the roof bolt 12 is rotated, the contents of the resin cartridge are mixed together. Also, by virtue of the frictional engagement of the expansion shell 16 with the rock formation surrounding the bore hole, the expansion shell 16, the camming plug 18, and the support device 20 move downwardly along the bolt 12 until the support device 20 reaches a thread runout or unthreaded portion 48 of the bolt 12. Of course, if the support device 20 is initially positioned adjacent the unthreaded portion 48, this step will not occur.

In either case, with the support device 20 located at the thread runout 48 and maintaining the expansion shell 16 at a fixed axial position on the bolt 12, continued rotation of the bolt 12 allows the tapered plug 18 to advance downwardly on the bolt 12 thereby urging the expansion fingers 24 radially outwardly to engage the rock formation. More particularly, the outwardly tapered portion 42 of the support device 20 cooperates with the circular base portion 22 of the expansion shell 16 thereby maintaining the expansion shell 16 in a fixed axial position on the bolt 12.

Finally, with the expansion shell 16 engaged with the rock formation, continued rotation of the bolt 12 increases the axial force between the expansion shell 16 and the support device 20. By virtue of the outwardly tapered portion 42 of the support device 20, the increasing axial force is accompanied by an increasing radial force which urges the circular base portion 22 of the expansion shell 16 to increase in diameter. Thus, because of the tapered portion 42 and/or the precisely controlled diameter of the base portion 22, the circular base portion 22 of the expansion shell 16 diametrically expands at a predetermined axial force, such as approximately 4,300 lbs., and a corresponding bolt torque, such as a torque of less than approximately 100 ft. lbs., sufficient enough to allow the support device 20 to traverse axially within and through the base portion 22 of the expansion shell 16 thereby allowing the bolt 12 to advance upwardly and be properly tensioned.

More specifically, a reference point or datum 50 on the support device 20 converges with a reference point or datum 52 on the circular base portion 22 after or while the diametric expansion of base portion 22 occurs at the predetermined force and corresponding bolt torque. That is, a distance D between the datums 50 and 52 is reduced at the predetermined force and corresponding bolt torque. The relative movement between the support device 20 and the circular base portion 22 is unlike the prior art where the circular base portion and the support device move in tandem down the mine roof bolt when the support device strips off the threaded portion of the bolt. It should be appreciated that in the embodiment illustrated the support device 20 axially traverses through the circular base portion 22 but other variations are possible, such as having the support device axially traverse annularly around the circular base portion, and all such variations are to be considered within the scope of the present invention. Also, it will be appreciated that the circular base portion 22 may or may not fracture during this diametric expansion and traversing movement.

Figure 2A:
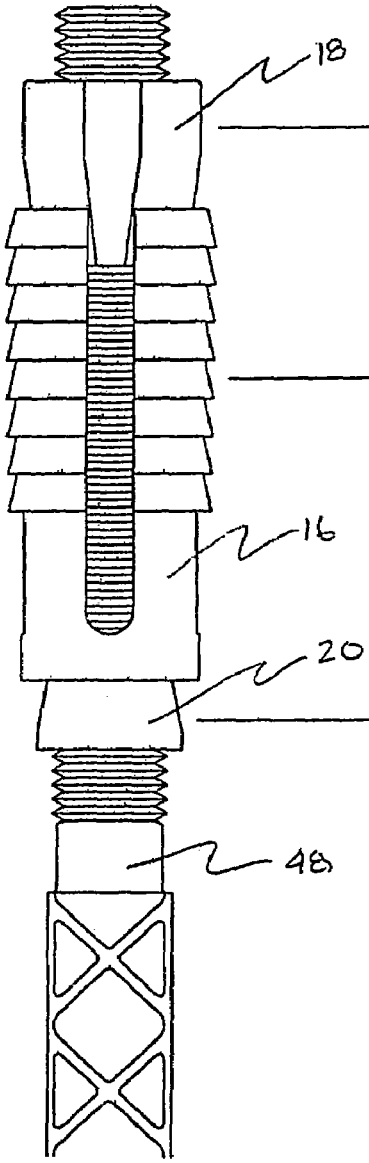
FIG. 2*a* is an elevational view of an expansion shell assembly on a mine roof bolt in a conventional shell arrangement in accordance with a second preferred embodiment of the present invention.
Figure 2B:
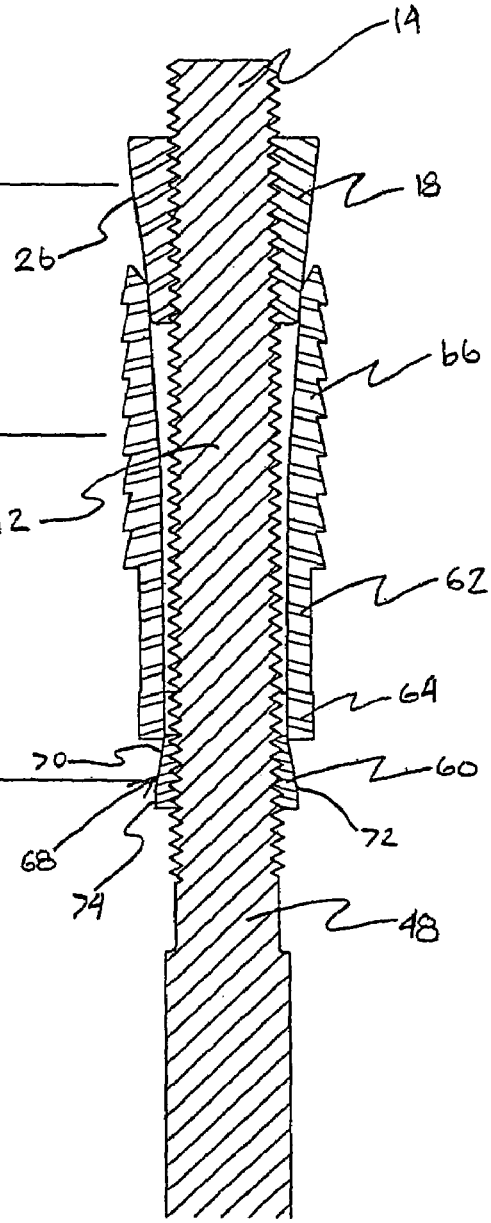
FIG. 2*b* is a cross section view of the expansion shell assembly of FIG. 2*a;*

With reference to FIGS. 2*a* and 2*b*, a second preferred embodiment of the present invention is illustrated. In this embodiment, an expansion shell assembly in a conventional shell arrangement comprises the tapered camming plug 18, a support device 60, and a conventional expansion shell 62.

The expansion shell 62 has a circular base portion 64 and a plurality of longitudinally extending fingers 66 generally spaced apart from one another. The circular base portion 64 of the expansion shell 62 is as typically manufactured, for example, an expansion shell commonly known as a D8 manufactured by Frazer & Jones of Syracuse, N.Y.

Like the precisely controlled diameter arrangement, each finger 66 is formed integral at one end portion with the circular base portion 64 and extends upwardly therefrom to form a free end portion for outward expansion of the finger 66. The fingers 66 each have an inner surface for engaging one of the plurality of flat side walls 26 of the camming plug 18 and an outer surface for frictionally engaging a bore hole (not shown) formed within a rock formation.

The support device 60 has, like the support device 20, a threaded axial bore for threaded engagement with the bolt 12, a lower end, an upper end whose outer diameter is less than the lower end, and a surrounding side wall 68 that transitions outwardly from the upper end to the lower end. The outer transition surface 68 has an outwardly and gradually tapered portion 70 beginning at the upper end, a transition radius portion 72 (such as about 0.030 inches), and a straight portion 74 that is parallel to the axial bore ending at the lower end. In this arrangement, the tapered portion 70 is angled at approximately ten degrees relative to a vertical axis of the bolt 12. Of course, other taper angles can be used to accomplish the same result and all such configurations are to be considered within the scope of the present invention.

For installation in the bore hole, the support device 60, the expansion shell 62, and the camming plug 18 are positioned on the threaded end portion 14 of the mine roof bolt 12 as illustrated. More specifically, the support device 60 is threaded onto the bolt 12 to a position located slightly above the unthreaded portion 48 of the bolt 12 as illustrated. Like the precisely controlled diameter arrangement, the support device 60 alternatively can be threaded onto the bolt 12 until it reaches or is adjacent the unthreaded portion 48. The expansion shell 62 and the camming plug 18 are positioned on the bolt 12 such that the circular base portion 64 slightly overlaps the support device 60. Thus, the expansion shell 62 is sandwiched between the camming plug 18 and the support device 60. The remainder of the installation process occurs very similarly to the installation process described above in reference to the precisely controlled diameter arrangement with a few differences.

The main difference during installation is that when the circular base portion 64 of the expansion shell 62 diametrically expands, the expansion is likely to be sufficient enough to fracture the circular base portion 64. That is, a predetermined axial force and corresponding bolt torque will cause the circular base portion 64 of the expansion shell 62 to diametrically expand sufficient enough to fracture. This is due, at least in part, to the transition surface 68 of the support device 60. The expansion and subsequent fracture allows the support device 60 to traverse axially within and through the base portion 64 of the expansion shell 62 at a predetermined axial force, such as approximately 4,300 lbs., thereby allowing the bolt 12 to advance upwardly and be properly tensioned. It may be, however, possible to diametrically expand the base portion 64 of the conventional shell 62 without fracturing it. In either case, the support device 60 is permitted to axially traverse relative to the expansion shell base portion 64 in the manner described in the controlled diameter arrangement.

Figure 3A:
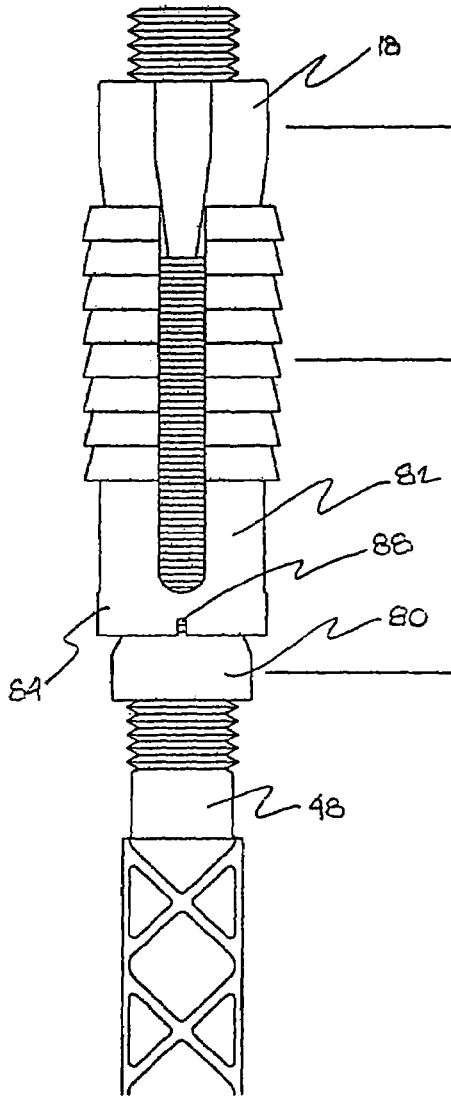
FIG. 3*a* is an elevational view of an expansion shell assembly on a mine roof bolt in a notched shell arrangement in accordance with a third preferred embodiment of the present invention.
Figure 3B:
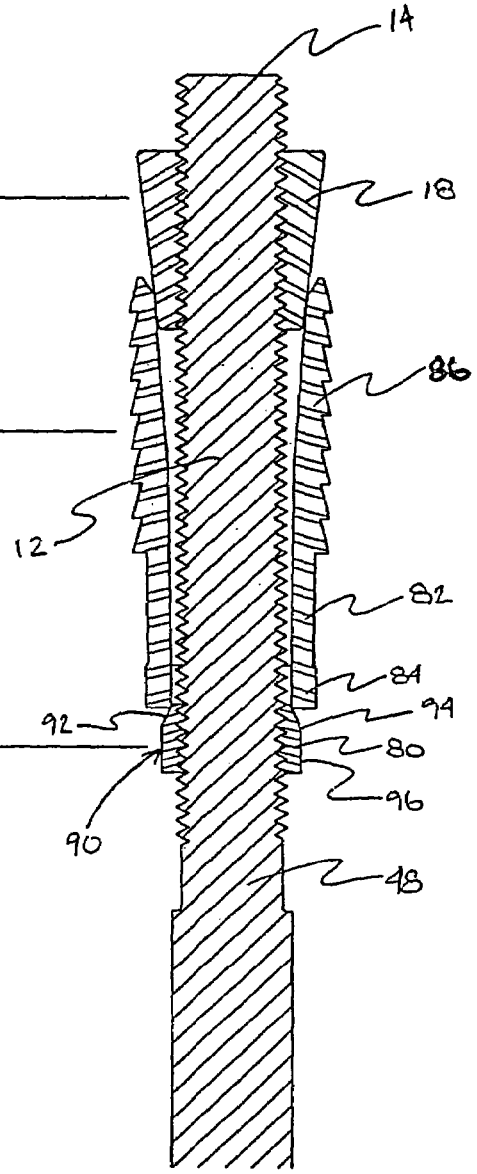
FIG. 3*b* is a cross sectional view of the expansion shell assembly of FIG. 3*a;*

With reference to FIGS. 3*a* and 3*b*, a third preferred embodiment of the present invention is illustrated. In this embodiment, an expansion shell assembly in a notched shell arrangement comprises the tapered camming plug 18, a support device 80, and a notched expansion shell 82.

The expansion shell 82 has a circular base portion 84 and a plurality of longitudinally extending fingers 86 generally spaced apart from one another. The geometry of the circular base portion 84 of the expansion shell 82 is modified to reduce the strength of the base portion 84. Specifically, the modification comprises adding at least one notch 88 in the base portion 84. However, it is to be appreciated that a variety of configuration changes could be made in order to achieve the desired result of weakening the base portion 84. For example, the base portion 84 may include, without limitation, one or more slots, holes, slits, deformations, channels, relieved areas or the like that may or may not extend completely through the circular base portion 84. The fingers 86 are disposed in the same manner as the previously discussed preferred embodiments.

The support device 80, like the support devices 20 and 60, has a threaded axial bore for threaded engagement with the bolt 12, a lower end, an upper end whose outer diameter is less than the lower end, and a surrounding side wall 90 that transitions outwardly from the upper end to the lower end. The outer transition surface 90 has an outwardly tapered portion 92 beginning at the upper end, a transition radius portion 94 (such as about 0.030 inches), and a straight portion 96 that is parallel to the axial bore ending at the lower end. In this arrangement, the tapered portion 92 is angled at approximately twenty-five degrees relative to the vertical axis of the bolt 12. Of course, other taper angles can be used to achieve the same result and all such configurations are to be considered within the scope of the present invention.

For installation, the support device 80, the expansion shell 82, and the camming plug 18 are positioned on the threaded end portion 14 of the mine roof bolt 12 as illustrated. More specifically, the support device 80 is threaded onto the bolt 12 to a position located slightly above the unthreaded portion 48 of the bolt 12 as illustrated. Like the previous arrangements, the support device 80 alternatively can be threaded onto the bolt 12 until it reaches or is adjacent the unthreaded portion 48. The notched expansion shell 82 and the camming plug 18 are positioned on the bolt 12 such that the circular base portion 84 slightly overlaps the support device 80. Thus, the expansion shell 82 is sandwiched between the camming plug 18 and the support device 80. The remainder of the installation process occurs very similarly to the installation process described above in reference to the conventional shell arrangement. However, in this embodiment the diametric expansion and possible fracturing of the circular base portion 84 is facilitated by the notches 88 in the expansion shell 82 at a predetermined axial force, such as approximately 4,400 lbs.

Figure 4A:
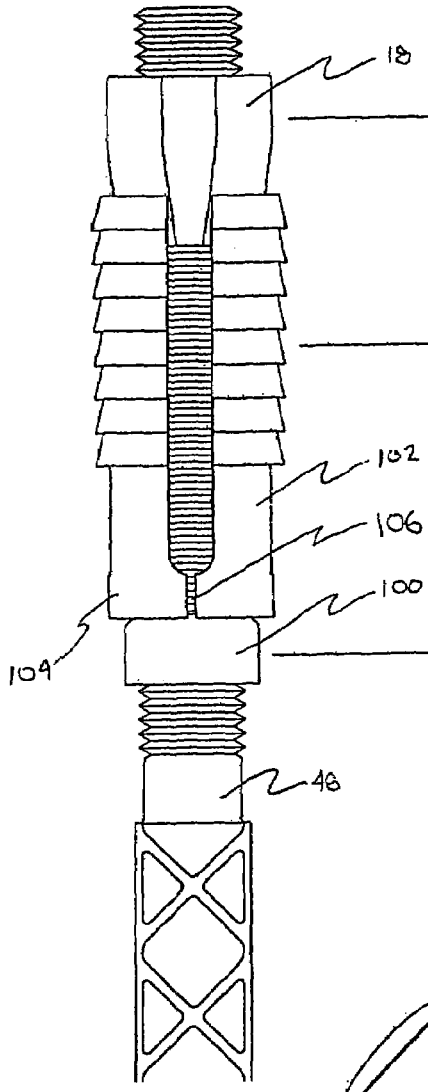
FIG. 4*a* is an elevational view of an expansion shell assembly on a mine roof bolt in a split shell arrangement in accordance with a fourth preferred embodiment of the present invention.
Figure 4B:
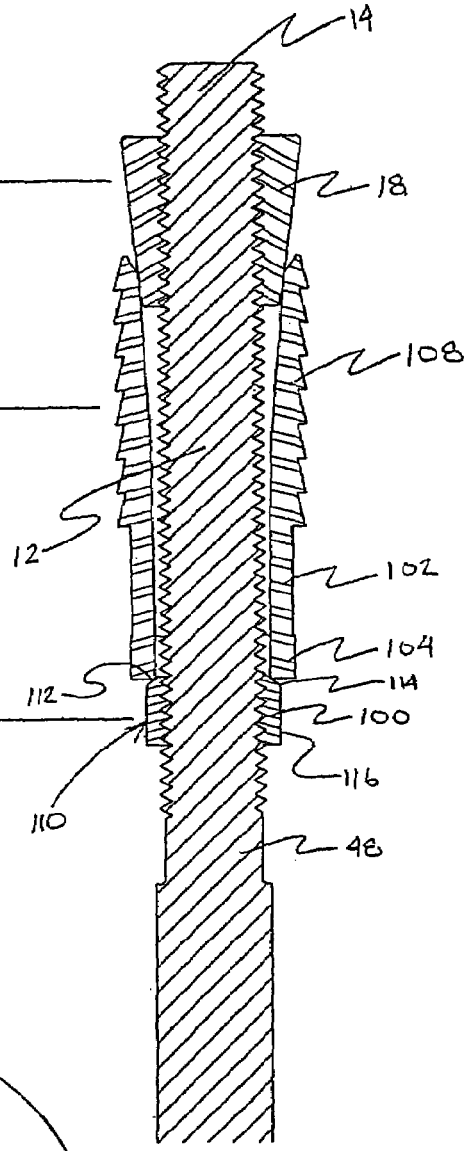
FIG. 4*b* is a cross sectional view of the expansion shell assembly of FIG. 4*a;*
Figure 4C:
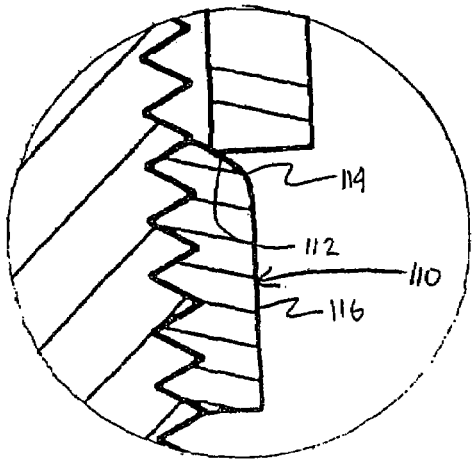
FIG. 4*c* is an enlarged partial view of a support device taper and radius of the expansion shell assembly of FIG. 4*a;*

With reference to FIGS. 4*a*, 4*b* and 4*c*, a fourth preferred embodiment of the present invention is illustrated. In this embodiment, an expansion shell assembly in a split shell arrangement comprises the tapered camming plug 18, a support device 100, and a circumferentially discontinuous expansion shell 102.

The expansion shell 102 has a circular base portion 104 that is a non-continuous circular structure. More specifically, the base portion 104 defines a slot or split 106 and does not form a closed annular ring. Fingers 108 are still formed integrally with the circular base portion 104 and extend upwardly therefrom as described with reference to the prior arrangements.

The support device 100, like the support devices 20, 60 and 80 has a threaded axial bore for threaded engagement with the bolt 12, a lower end, an upper end whose diameter is less than the lower end, and a surrounding side wall 110 that transitions outwardly from the upper end to the lower end 2. With specific reference to FIG. 4*c*, the outer transition surface 110 has an outwardly tapered portion 112 beginning at the upper end, a transition radius portion 114 (such as about 0.030 inches), and a straight portion 116 that is parallel to the axial bore ending at the lower end. In this arrangement, the tapered portion 112 is angled at approximately fifty-five degrees relative to the vertical axis of the bolt 12. Of course, other taper angles can be used to achieve the same result and all such configurations are to be considered within the scope of the present invention.

For installation, the support device 100, the expansion shell 102, and the camming plug 18 are positioned on the threaded end portion 14 of the mine roof bolt 12 as illustrated. More specifically, the support device 100 is threaded onto the bolt 12 to a position located slightly above the unthreaded portion 48 of the bolt 12 as illustrated. Like the previous arrangements, the support device 100 alternatively can be threaded onto the bolt 12 until it reaches or is adjacent the unthreaded portion 48. The expansion shell 102 and the camming plug 18 are positioned on the bolt 12 such that the circular base portion 104 slightly overlaps the support device 100. Thus, the expansion shell 102 is sandwiched between the camming plug 18 and the support device 100. The remainder of the installation process occurs very similarly to the installation process described above in reference to the precisely controlled diameter arrangement. However, in this embodiment the diametrical expansion of the circular base portion 104 at a predetermined axial force, such as approximately 5,000 lbs., is facilitated by the gap or slot 106 in the expansion shell 102.

Figure 5A:
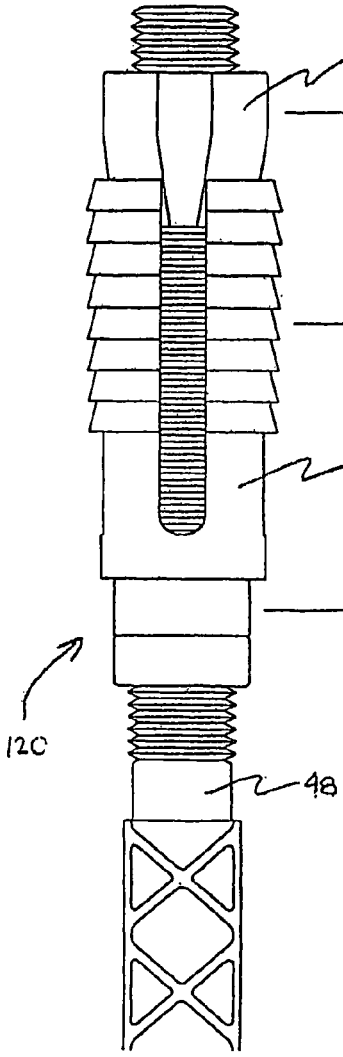
FIG. 5*a* is an elevational view of the precisely controlled diameter arrangement of FIG. 1 wherein a two-piece support device is substituted for the support device of FIG. 1.
Figure 5B:
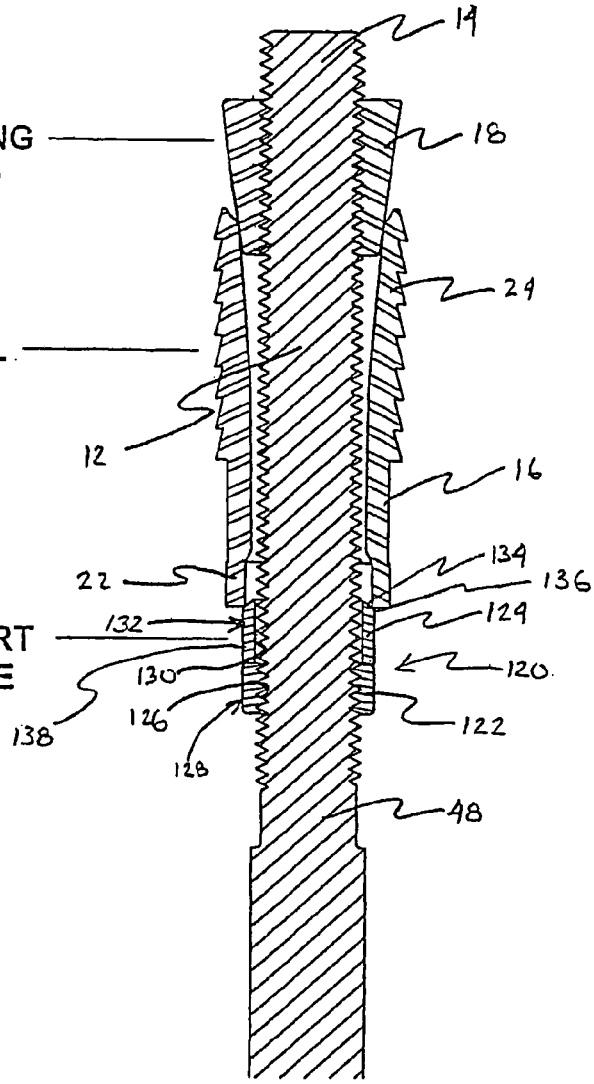
FIG. 5*b* is a cross sectional view of the precisely controlled diameter arrangement of FIG. 5*a;*

With reference to FIGS. 5*a* and 5*b*, an alternative two-piece support device may be used in place of any of the aforementioned support devices 20, 60, 80 or 100. As shown, a two-piece support device 120 is substituted for the support device 20 in the precisely controlled diameter arrangement. The support device 120 comprises a lower threaded ring 122 and an unthreaded upper ring 124. The lower ring 122 has a threaded axial bore 126, a lower end, an upper end, and a surrounding side wall 128. The side wall or outer surface 128 may be circular, hex, or otherwise shaped.

Although the upper ring 124 has an unthreaded axial bore 130 for sliding engagement over the threads of the bolt 12, in most other respects the upper ring 124 is like the support device 20, 60, 80 or 100 that the two-piece support device is being substituted for, in this case the support device 20. Thus, the upper ring 124 has a lower end, an upper end, and a surrounding side wall 132 that transitions outwardly form the upper end to the lower end. The outer transition surface 132 has an outwardly tapered portion 134 at the same angle as that of the tapered portion of the support being substituted for, in this case sixty degrees. The upper ring 124 also has a transition radius portion 136 and a straight portion 138 that is parallel to the axial bore 130.

For installation, the lower ring 122, the upper ring 124, the expansion shell 16, and the camming plug 18 are positioned on the threaded end portion 14 of the mine roof bolt 12 as illustrated. More specifically, the lower ring 122 is threaded onto the bolt 12 to a position located slightly above the unthreaded portion 48 as illustrated. Like all the other arrangements, the lower ring 122 can alternatively be positioned at or adjacent the unthreaded portion 48. The upper ring 124 is then slid onto the bolt 12. Next, the expansion shell 16 and the camming plug 18 are positioned on the bolt 12 such that the circular base portion 22 slightly overlaps the tapered surface 134 of the upper ring 124 as shown. The remainder of the installation occurs like the installation process described in reference to the precisely controlled diameter arrangement. However, rotation of the bolt 12 with the lower ring 122 located at thread runout 48 causes the lower ring 122 to rotate with the bolt 12. Whereas, the upper ring 124 may not rotate, thus less torque is transferred to the expansion shell 16.

As discussed above, it should be appreciated that a similar two-piece support device may be used with any of the other previously described arrangements. However, an exterior of the upper ring would be shaped like the support device 60, 80 or 100 being substituted. For example, if a two-piece support device is used in place of the support device 60 of FIG. 2*a*, the upper ring will be shaped like the support device 60 except that the axial bore will be unthreaded. Thus, if the two-piece support device is used in the conventional shell arrangement, a tapered portion of the upper ring will have an angle of approximately ten degrees.

Figures 6A, 6B:
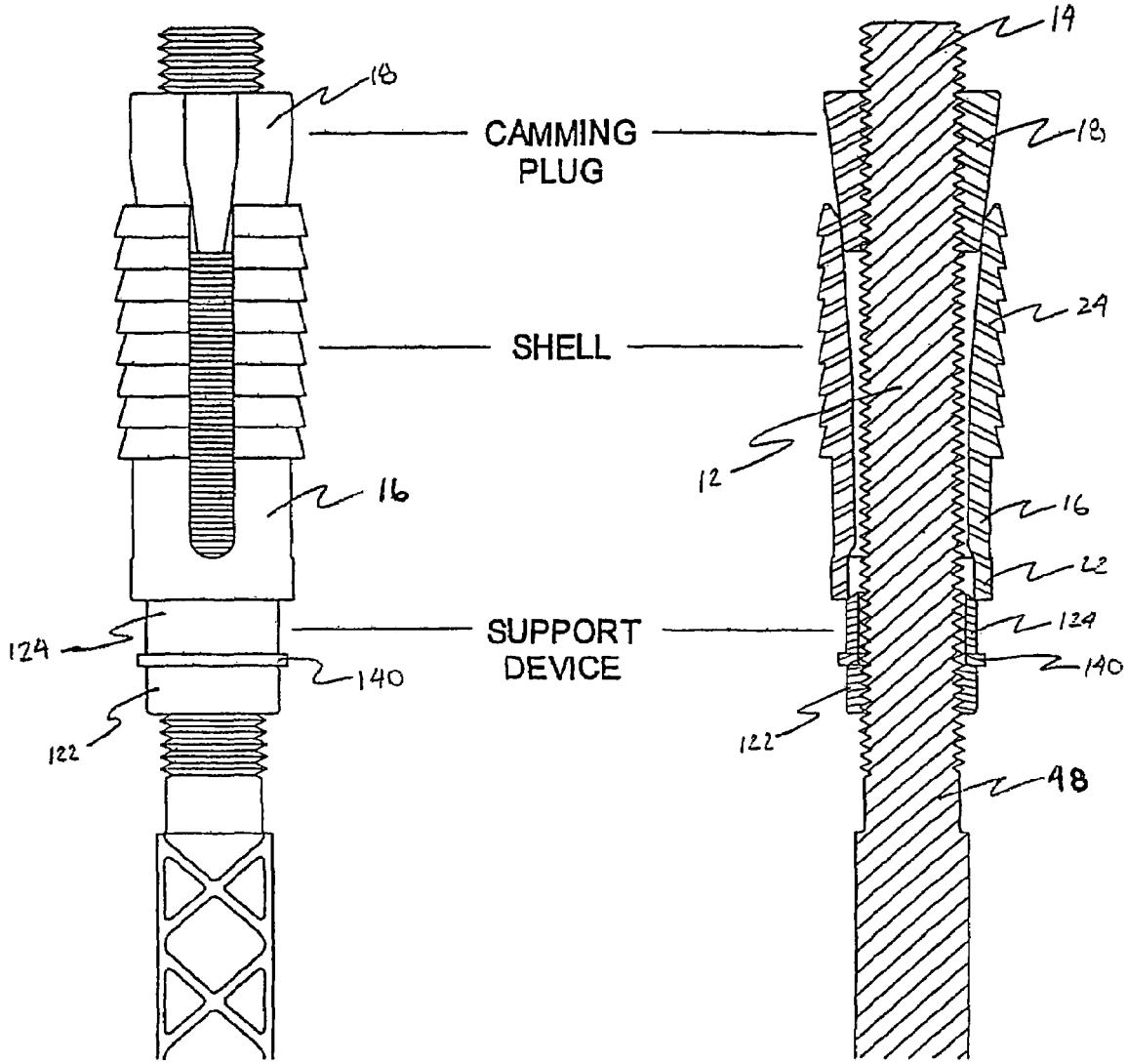
FIG. 6*a* is an elevational view of the precisely controlled diameter arrangement of FIG. 1 wherein a two-piece support device having an antifriction washer is substituted for the support device of FIG. 1.
FIG. 6*b* is a cross sectional view of the precisely controlled diameter arrangement of FIG. 6*a;*

It may also be desirable to add an antifriction washer between the rings of any two-piece support device. With reference to FIGS. 6*a* and 6*b*, an antifriction washer 140 is provided with the two-piece support device 120 between the lower ring 122 and the upper ring 124. The antifriction washer 140 is one way to reduce the friction between the upper and lower rings 122,124. Installation occurs in the same manner as described with reference to the two-piece support device discussed previously. Also, it should be appreciated that a two-piece support device having an antifriction washer may be used with any other previously described arrangements in the manner described above in reference to the two-piece support device without an antifriction washer.

Another way to reduce the friction between the upper and lower rings in any arrangement is to coat the upper ring or lower ring with an antifriction material such as Teflon. It should be appreciated that any other antifriction method could be used to achieve a similar effect. Further, any of the antifriction methods discussed herein could be used in any of the aforementioned arrangements.

With reference to FIGS. 7*a* and 7*b*, another preferred embodiment of the present invention is illustrated. In this embodiment, a mine roof bolt is provided without an unthreaded portion between its threaded end and shoulder. An unthreaded support device is slidably received on the bolt and rests against its shoulder. In many respects the support device of this embodiment is like the upper ring of the two-piece support device. Instead of providing a lower ring, the shoulder of the bolt is used to limit downward axial movement of the support device.

This embodiment may be used with any of the previously described arrangements. However, the outer surface configuration of the support device is dependent upon the shell and support device arrangement desired. FIGS. 7*a* and 7*b*, a precisely controlled diameter arrangement is illustrated. Thus, an outer contour or outer transition surface 148 of a support device 150 is like the outer contour of the support device 20 of FIGS. 1*a* and 1*b* and the precisely controlled diameter shell 16 of FIGS. 1*a* and 1*b* is provided. Also, the taper angle of a tapered portion 152 of the support device 150 can be like the taper angle of the support device 20 such as sixty degrees. The support device 150 has an unthreaded bore 156.

For installation, the support device 150 is slid onto a bolt 158 that does not have an unthreaded portion between a shoulder 160 and its threaded portion 162. The support device 150 is positioned against the shoulder 160. The precisely controlled diameter expansion shell 16 and the camming plug 18 are placed on the bolt 158 as described in reference to the precisely controlled diameter arrangement of FIGS. 1*a* and 1*b*. In fact, the remainder of the installation also occurs as described in reference to the precisely controlled diameter arrangement of FIGS. 1*a* and 1*b*.

Alternatively, an antifriction washer (not shown) such as the antifriction washer 140 can be used between the shoulder 160 of the bolt 158 and the support device 150.

Although FIGS. 7*a* and 7*b* illustrates the precisely controlled diameter arrangement, the support device 150 and/or shell 16 could be modified or substituted to create any of the other aforementioned arrangements. For example, the conventional shell arrangement could be utilized by using a conventional shell 62 and a support device having an outer contour like that of the support device 60 of FIGS. 2*a* and 2*b*. Likewise, the notched shell and split shell arrangements could also be utilized by similar modifications and/or substitutions to the shell and the support device.

Figure 8A:
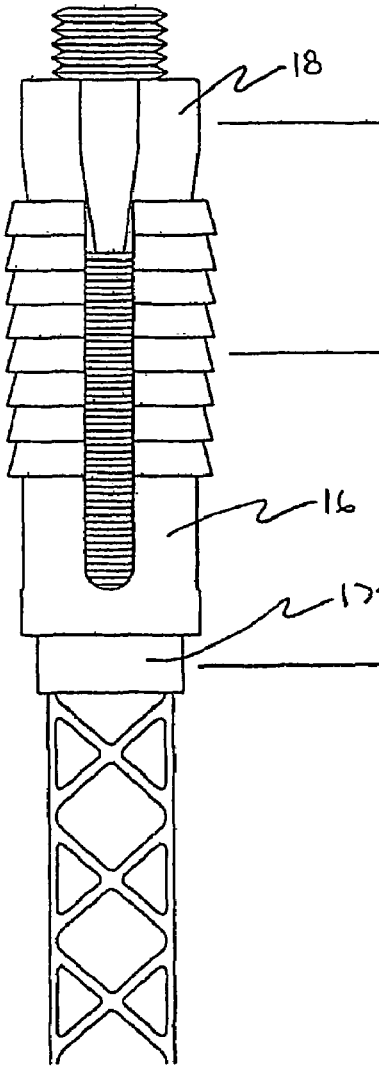
FIG. 8*a* is an elevational view of an expansion shell assembly on a mine roof bolt having a support device axially secured between rolled threads and a shoulder of the bolt in a precisely controlled diameter arrangement in accordance with another preferred embodiment of the present invention.
Figure 8B:
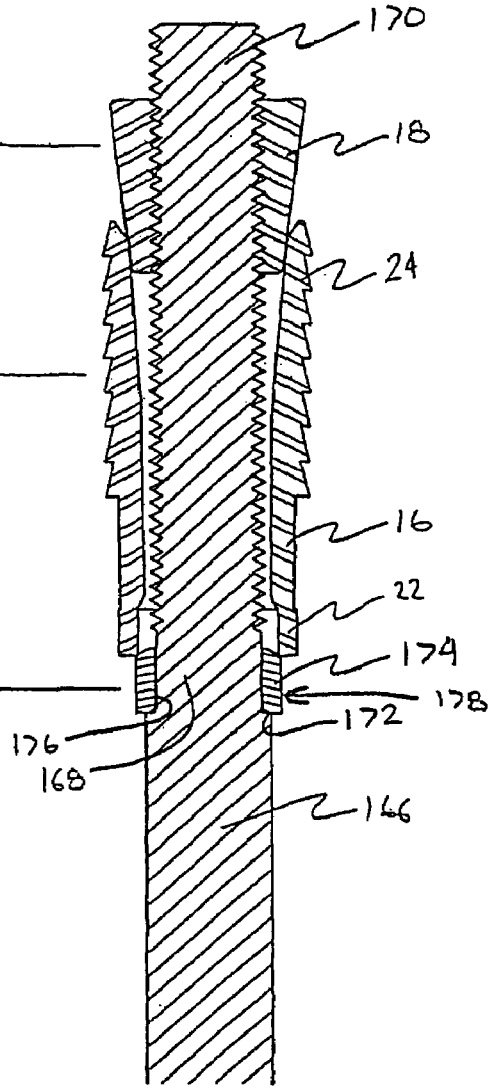
FIG. 8*b* is a cross sectional view of the expansion shell assembly of FIG. 8*a;*

With reference to FIGS. 8*a* and 8*b*, another preferred embodiment of the present invention is illustrated. In this embodiment, a bolt 166 includes an unthreaded portion 168 between a threaded end 170 and a shoulder 172 but the threads are rolled on after a support device 174 is slid onto the bolt 166 and positioned adjacent the shoulder 172. Thus, the diameter of an axial bore 176 of the support device 174 is substantially similar to the diameter of the unthreaded portion 168 of the bolt 166.

As described with reference to the support device 160 of FIGS. 7*a* and 7*b*, an outer surface configuration of the unthreaded support device of this embodiment varies and is dependent upon the shell and support device arrangement desired. In FIGS. 8*a* and 8*b*, a precisely controlled diameter arrangement is illustrated. Thus, an outer contour or outer transition surface 178 of the support device 174 is like the outer contour of the support device 20 of FIGS. 1*a* and 1*b*. Also, the taper angle can be like the taper angle of the support device 20 such as sixty degrees.

For manufacture, the support device 174 is slid onto the bolt 166 and positioned adjacent the shoulder 172 prior to the threads being rolled on the bolt 166. The threads are then rolled on the bolt 166 thereby securing the axial position of the support device 174. More specifically, the threads have an outer diameter greater than the diameter of the axial bore 176 of the support device 174 thereby preventing upward axial movement of the support device 174. The shoulder 172 of the bolt 166 prevents downward axial movement. For installation, the expansion shell 16 and the camming plug 18 are placed on the bolt as described in reference to the precisely controlled diameter arrangement of FIGS. 1*a* and 1*b*. In fact, the remainder of the installation occurs as described with reference to the precisely controlled diameter arrangement of FIGS. 1*a* and 1*b*.

Alternatively, an antifriction washer (not shown) such as the antifriction washer 140 can be used between the shoulder 172 of the bolt 166 and the support device 174.

Although FIGS. 8*a* and 8*b* illustrates the precisely controlled diameter arrangement, the support device 174 and/or shell 18 could be modified or substituted to create any of the other aforementioned arrangements. For example, the conventional shell arrangement could be utilized by using a conventional shell 62 and a support device having an outer contour like that of the support device 60 of FIGS. 2*a* and 2*b*. Likewise, the notched shell and split shell arrangements could also be utilized by similar modifications and/or substitutions to the shell and the support device.

Figures 9A, 9B:
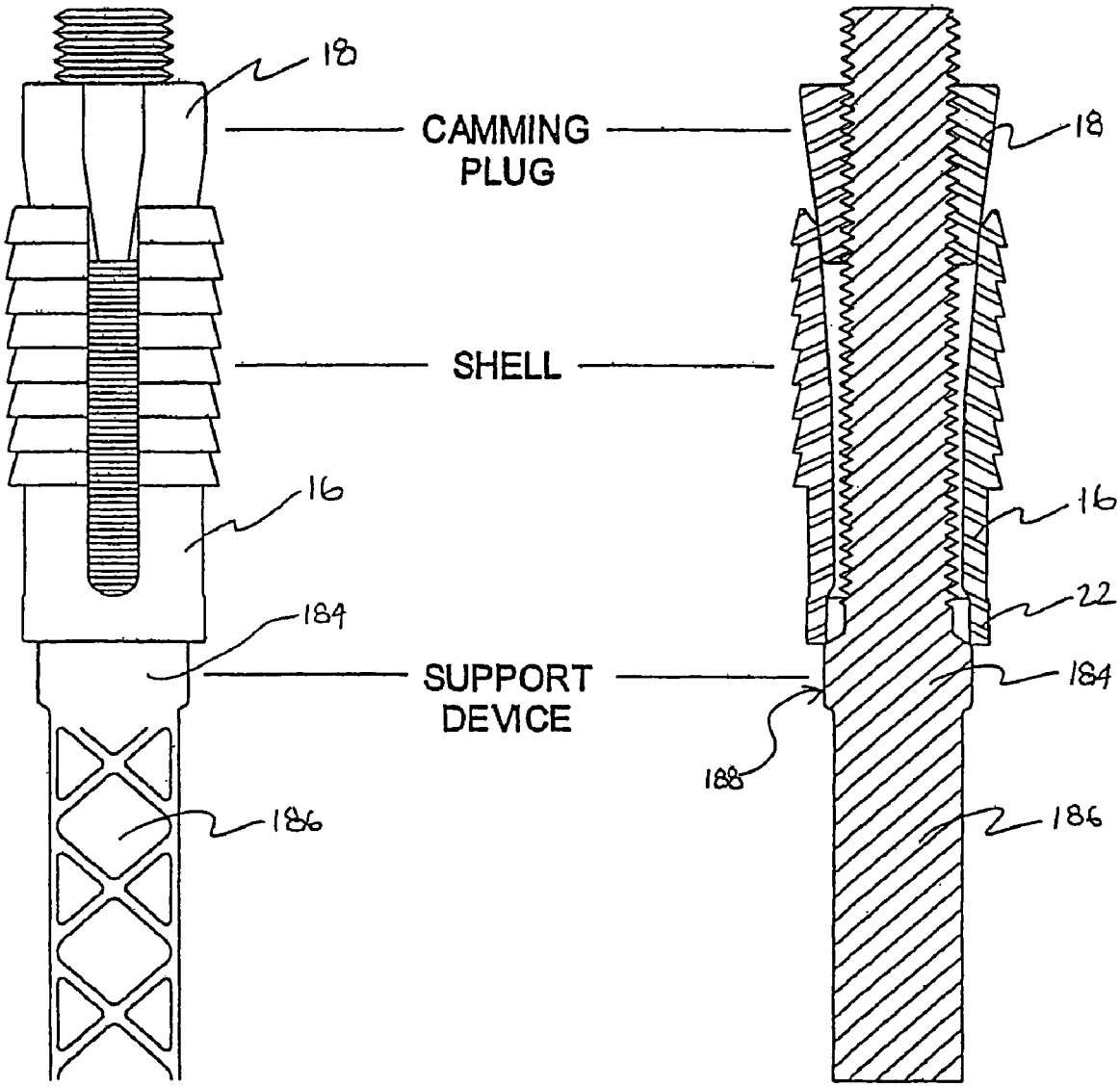
FIG. 9*a* is an elevational view of an expansion shell assembly on a mine roof bolt having a support device formed integrally with the bolt in a precisely controlled diameter arrangement in accordance with a ninth preferred embodiment of the present invention.
FIG. 9*b* is a cross sectional view of the expansion shell assembly of FIG. 9*a;*
Figures 10A, 10B:
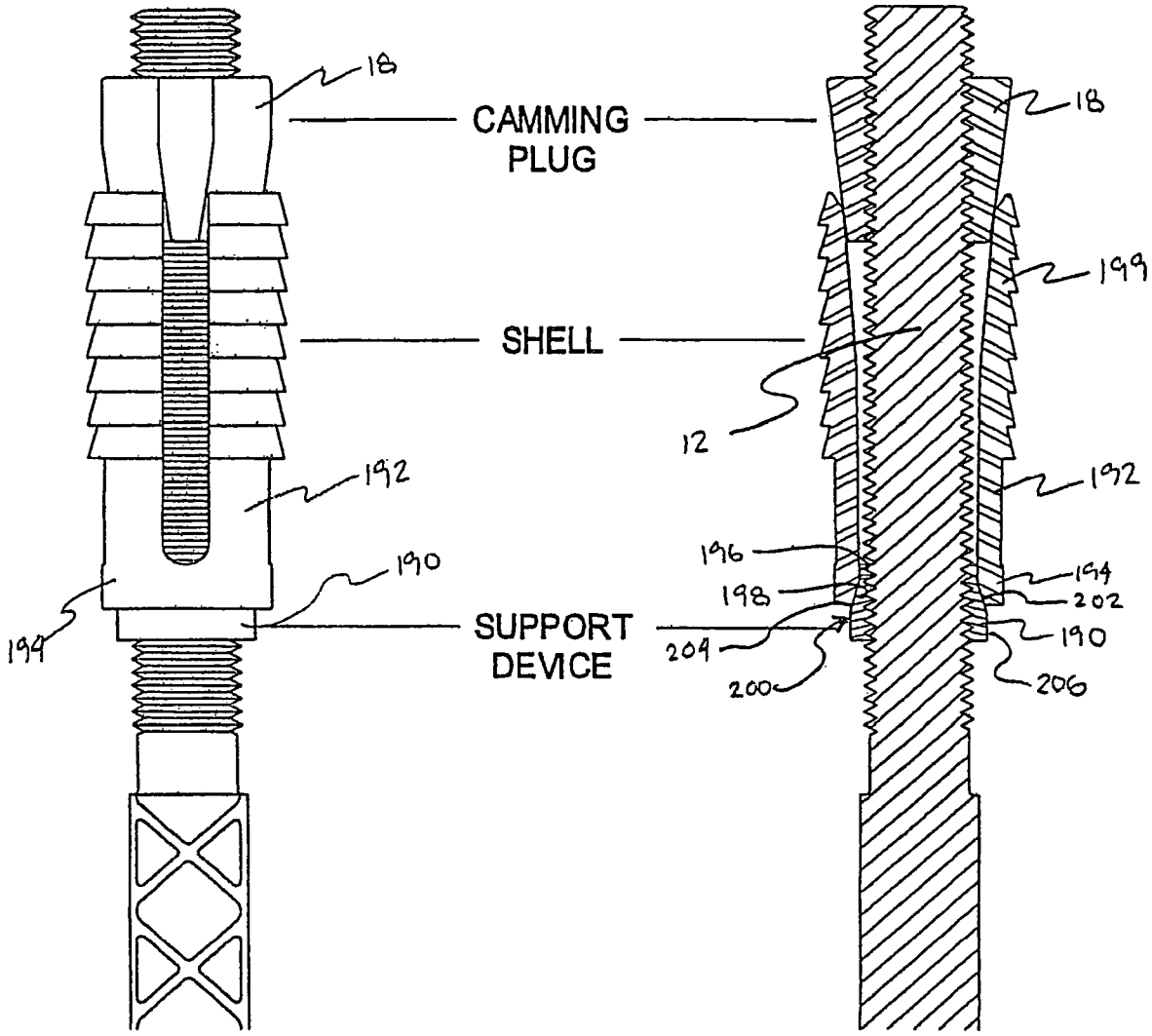
FIG. 10*a* is an elevational view of an expansion shell assembly having a tapered shell engaged to a tapered support device on a mine roof bolt in accordance with another preferred embodiment of the present invention.
FIG. 10*b* is a cross sectional view of the expansion shell assembly of FIG. 10*a.*

With reference to FIGS. 9*a* and 9*b*, another preferred embodiment of the present invention is illustrated. In this embodiment, a support device 184 is formed integrally with or as part of a bolt 186. Again, the outer surface configuration of the support device varies and is dependent upon the shell and support device arrangement desired. In FIGS. 9*a* and 9*b*, a precisely controlled diameter arrangement is illustrated. Thus, the outer contour or outer transition surface 188 of the support device 184 is like the outer contour of the support device 20 of FIGS. 1*a* and 1*b*. Also, the taper angle can be like the taper angle of the support device 20 such as sixty degrees.

Installation occurs like the precisely controlled diameter arrangement of FIGS. 1*a* and 1*b* except that the support device 184 is already on the bolt 186.

Again, FIGS. 9*a* and 9*b* only illustrate the precisely controlled diameter arrangement. Alternatively, the support device 184 and/or shell 18 could be modified or substituted to create any of the other aforementioned arrangements. For example, the conventional shell arrangement could be utilized by using a conventional shell 62 and a support device having an outer contour like that of the support device 60 of FIGS. 2*a* and 2*b*. Likewise, the notched shell arrangement and the split shell arrangement could also be utilized in the manner described in reference to the support device 184.

With reference to FIGS. 10*a* and 10*b*, yet another embodiment of the present invention is illustrated. In this embodiment, an expansion shell assembly comprises the tapered camming plug 18, a support device 190, and an expansion shell 192.

The expansion shell 192 has a circular base portion 194 that includes an inner surface 196 having an inward taper 198 from a lower end portion of the base portion 194 to engage a corresponding taper on the support device 190. The expansion shell 192 also has a plurality of longitudinally extending fingers 199 generally spaced apart from one another.

Like the precisely controlled diameter shell 16 of FIGS. 1*a* and 1*b*, each finger 199 is formed integral at one end portion with the circular base portion 194 and extends upwardly therefrom to form a free end portion for outward expansion of the finger 199. The fingers 199 each have an inner surface for engaging one of a plurality of flat side walls of the camming plug and an outer surface for frictionally engaging a bore hole (not shown) formed in a rock formation.

The support device 190 has a threaded axial bore for threaded engagement with the bolt 12, a lower end, an upper end whose outer diameter is less than the lower end, and a surrounding side wall 200 that transitions outwardly from the upper end to the lower end. The outer transition surface 200 has corresponding taper or tapered portion 202 beginning at the upper end that corresponds to the inward taper of the shell 192, a transition radius portion 204 (such as about 0.030 inches), and a straight portion 206 that is parallel to the axial bore ending at the lower end.

Installation occurs as described above with reference to the precisely controlled diameter shell arrangement of FIGS. 1*a* and 1*b*. However, upon continued rotation of the bolt 12 the axial force between the expansion shell 192 and the support device 190 increases. By virtue of this increasing axial force and corresponding increasing friction between the expansion shell 192 and support device 190, the support device 190 is held in a fixed, non-rotating position. Thus at a predetermined bolt torque, the support device 190 is held in a fixed, non-rotating position thereby allowing the bolt 12 to advance upwardly and be properly tensioned.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the present invention, it is now claimed:

1. A bolt and anchor assembly for securing a mine roof bolt, comprising:

a bolt;

a shell disposed on said bolt, said shell having a first end and a second end;

an expansion member axially disposed on said bolt adjacent said second end of said shell for expanding said shell to anchor said elongated bolt in an associated bore hole; and a support device axially disposed on said bolt adjacent said first end of said shell, engagement between said support device and said shell sequentially (1) forces said expansion member into said shell to expand said shell to anchor said bolt in said associated bore hole while said support device remains axially fixed relative to said shell and (2) then only after said bolt is anchored in said associated bore hole allows axial movement of said support device in a direction toward and relative to said shell, a base ring at said first end of said shell includes at least one split that extends to a recess defined between adjacent fingers of said shell and thereby facilitates said axial movement of said support device in said direction toward and relative to said shell to allow said support device to move through said base ring.

2. The bolt and anchor assembly of claim 1 wherein said axial movement of said support device in said direction toward and relative to said shell occurs only after a predetermined force is applied on said shell by said support device.

3. The bolt and anchor assembly of claim 1 wherein said base ring at said first end of said shell is nearly circumferentially continuous and said at least one split is only a single split to facilitate said first end of said shell being able to partially expand without engaging the associated bore hole upon application of a sufficient force on a bottom radial end of said base ring by said support device thereby facilitating said axial movement of said support device in said direction toward and relative to said shell and through said base ring.

4. The bolt and anchor assembly of claim 1 wherein said base ring is a radially thickened base ring and said at least one split is a weakened area that splits an otherwise circumferentially continuous structure and thereby facilitates said axial movement of said support device in said direction toward and relative to said shell to allow said support device to move through said base ring.

5. The bolt and anchor assembly of claim 1 wherein said axial movement of said support device in said direction toward and relative to said shell only occurs after a predetermined axial force of about 5,000 lbs. is applied on said shell by said support device.

6. The expansion shell assembly of claim 1 wherein the support device comprises a threaded lower support threadedly engaged with the elongated bolt and an upper support for reducing the amount of torque transferred to the expansion shell during installation.

7. The expansion shell assembly of claim 1 further comprising an antifriction washer adjacent a lower end of the support device for reducing the amount of torque transferred to the expansion shell during installation.

8. The expansion shell assembly of claim 1 wherein at least a portion of the support device includes an antifriction coating to reduce the amount of torque transferred to the expansion shell during installation.

9. The expansion shell assembly of claim 1 wherein the support device is unthreaded and slidably received on the bolt between a shoulder of the bolt spaced from a head of the bolt and a distal end of the bolt inserted into the associated bore hole.

10. The bolt and anchor assembly of claim 1 wherein the support device is formed integrally with the elongated bolt.

11. The bolt and anchor assembly of claim 1 wherein said support device has an outer transition surface that includes a straight portion generally parallel to an axis of the associated bolt and a tapered portion, and wherein said base ring engages said tapered portion while said fingers of said shell are expanded by said expansion member and engages said straight portion after said fingers have expanded and while the bolt is tensioned.

12. The bolt and anchor assembly of claim 11 wherein said support device includes a transition radius portion between said tapered portion and said straight portion and wherein said base ring includes an aperture through which the bolt is received, said aperture defined by an inner wall of said base ring that engages said tapered portion while said base ring is expanded and engages said straight portion thereafter while said support device axially moves into said shell.

13. An expansion shell assembly, comprising:

an elongated bolt;

an expansion shell having fingers only at one end for engaging a rock formation, an aperture for receiving the elongated bolt, and a base ring at an opposite end including a split that extends to a recess defined between adjacent ones of the fingers;

an expansion member disposed on one end of the elongated bolt for expanding the fingers of the expansion shell; and a shell support in contact with the elongated bolt and an opposite end of the expansion shell, the shell support (1) generally maintaining the axial position of the opposite end of the expansion shell relative to the elongated bolt while the expansion member forces the fingers of the shell to engage the rock formation and (2) moving axially relative to the expansion shell when the elongated bolt is tensioned after engagement the fingers of the shell to the rock formation, axial movement facilitated by the split in the base ring which allows the shell support to move through the base ring.

14. The expansion shell assembly of claim 13 wherein said shell support is threadedly engaged with said elongated bolt.

15. A method for anchoring and tensioning a mine roof bolt with an expansion shell assembly in a drilled hole, the expansion shell assembly including an expansion shell disposed on the mine roof bolt, an expansion member disposed on the mine roof bolt adjacent one end of the expansion shell for expanding the expansion shell and a support member disposed on the mine roof bolt adjacent another end of the expansion shell for supporting the expansion shell while the shell expands and tensioning the mine roof bolt after the shell expands, the expansion shell having a base ring at a first end thereof defining at least one split that extends to a recess defined between adjacent fingers of the expansion shell the method comprising:

inserting and advancing said mine roof bolt with said expansion shell assembly carried thereon upwardly into a drilled hole in a rock formation;

initially rotating said mine roof bolt to anchor said expansion shell assembly in said drilled hole with said support device axially fixed relative to said expansion shell; and further rotating said mine roof bolt, after said step of rotating said mine roof bolt to anchor said expansion shell assembly in said drilled hole, to significantly tension said mine roof bolt with said support device axially moving into said expansion shell, the at least one split in the base ring facilitating the support device axially moving into and through the base ring.

16. The method of claim 15 further including the steps of:

positioning said support device on an unthreaded portion of the roof bolt between a threaded portion of the roof bolt and a shoulder of the roof bolt;

subsequently rolling threads on the threaded portion to generally restrict axial movement of the support device.

17. The method of claim 15 wherein said step of rotating said mine roof bolt to anchor said expansion shell assembly including the sub-steps of:

forcing said support device against said expansion shell;

forcing said expansion shell against said support device; and forcing all fingers of said expansion shell to move radially outwardly to grip said rock formation.

18. The method of claim 15 wherein said step of further rotating said mine roof bolt includes the sub-steps of:

forcing said support device axially into said expansion shell; and diametrically expanding said base ring of said expansion shell to allow said support device to move axially into and through said base ring of said expansion shell without further anchoring said shell in said drilled hole.

19. The method of claim 15 wherein significant tensioning begins occurring when rotation of the mine roof bolt causes said support member to provide a sufficient force to radially expand said expansion shell enough to permit axial movement of said support member within said base ring of said expansion shell and continues as said support member moves into and through said base ring.

20. The method of claim 15 wherein the tensioning occurs when the rotation of the mine roof bolt causes the support to provide a sufficient force to permit axial movement of the support device within said expansion shell.

21. The method of claim 15 wherein said at least one split and said recess defined between said adjacent fingers together extend an entire longitudinal extent of said expansion shell.

22. The method of claim 15 wherein said support device is threaded onto said mine roof bolt to a position slightly above and spaced apart from an unthreaded portion of said mine roof bolt.

23. The method of claim 22 wherein said initial rotation of said mine roof bolt causes said support device to threadedly move downwardly along said mine roof bolt until reaching said unthreaded portion.

24. An expansion shell assembly for mine roof bolts, comprising:

an expansion member threaded onto an associated bolt;

a support device annularly disposed around the associated bolt; and a shell annularly disposed on the bolt between the expansion member and the support device, the shell having a base ring at one end thereof for engagement with the support device and fingers at an opposite end for engaging the expansion member, wherein said engagement between said base ring and said support device allows axial movement of said support device into and through said base ring of said shell to significantly and properly tension said associated bolt after said fingers of said shell are expanded by said expansion member, wherein a base ring at said first end of said shell includes at least one split that extends to a recess defined between adjacent fingers of said shell and thereby facilitates said axial movement of said support device in said direction toward and relative to said shell to allow said support device to move through said base ring.

25. The expansion shell assembly of claim 24 wherein said base ring has an outer diameter small enough relative to the bore hole such that engagement between said base ring and said support device allows axial movement of said support device into and through said base ring with said shell riding upward over said support device.

26. The expansion shell assembly of claim 24 wherein the base ring has an outside diameter larger than an adjacent portion of said shell and said fingers each include a plurality of tapered gripping teeth.

27. A bolt and anchor assembly for securing a mine roof bolt, comprising:

a bolt;

a shell disposed on said bolt, said shell having a first end and a second end;

an expansion member axially disposed on said bolt adjacent said second end of said shell for expanding said shell to anchor said elongated bolt in an associated bore hole; and a support device threadedly received on said associated bolt adjacent said first end of said shell, engagement between said support device and said shell sequentially (1) forces said expansion member into said shell to expand said shell to anchor said bolt in said associated bore hole while said support device remains generally axially fixed relative to said shell and (2) then after said bolt is anchored in said associated bore hole allows axial movement of said support device in a direction toward a relative to said shell; wherein a base ring at said first end of said shell includes at least one split that extends to a recess defined between adjacent fingers of said shell and thereby facilitates said axial movement of said support device in said direction toward and relative to said shell to allow said support device to move through said base ring.

* * * * *